United States Patent [19]

Zitting et al.

[11] 4,048,749

[45] Sept. 20, 1977

[54] MARIONETTE BIRD

[76] Inventors: Carl Edward Zitting; George Fredrick Zitting, both of P.O. Box 1767, Wenatchee, Wash. 98801

[21] Appl. No.: 696,554

[22] Filed: June 16, 1976

[51] Int. Cl.[2] ..... A63H 11/00

[52] U.S. Cl. ..... 46/126; 46/124

[58] Field of Search ..... 46/123, 124, 156

[56] References Cited

U.S. PATENT DOCUMENTS

| | | | |
|---|---|---|---|
| 407,142 | 7/1889 | Wobito | 46/120 |
| 572,166 | 12/1896 | Hoffmann | 46/124 |
| 1,721,091 | 7/1929 | Ritchie et al. | 46/126 |
| 2,421,279 | 5/1947 | Marty | 46/126 |
| 2,444,169 | 6/1948 | Paige | 46/126 |
| 2,468,997 | 5/1949 | Osgood | 46/126 |
| 2,638,705 | 5/1953 | Petrasy | 46/124 |
| 2,795,896 | 6/1957 | Snyder | 46/126 |
| 2,887,820 | 5/1959 | Beyer | 46/124 |

FOREIGN PATENT DOCUMENTS

| | | | |
|---|---|---|---|
| 1,103,201 | 3/1961 | Germany | 46/156 |

*Primary Examiner*—Russell R. Kinsey
*Assistant Examiner*—Robert F. Cutting
*Attorney, Agent, or Firm*—Schapp and Hatch

[57] ABSTRACT

A hand operated puppet which is operable from overhead puppet strings with the generally articulated figure of a bird. A plurality of styrofoam and fabric balls are strung together to form the legs and body with strips of fake fur attached to the body balls, and feathers on the head. One of the eyes is open and one closed to give the appearance that the bird is blinking.

5 Claims, 8 Drawing Figures

FIG. 6.
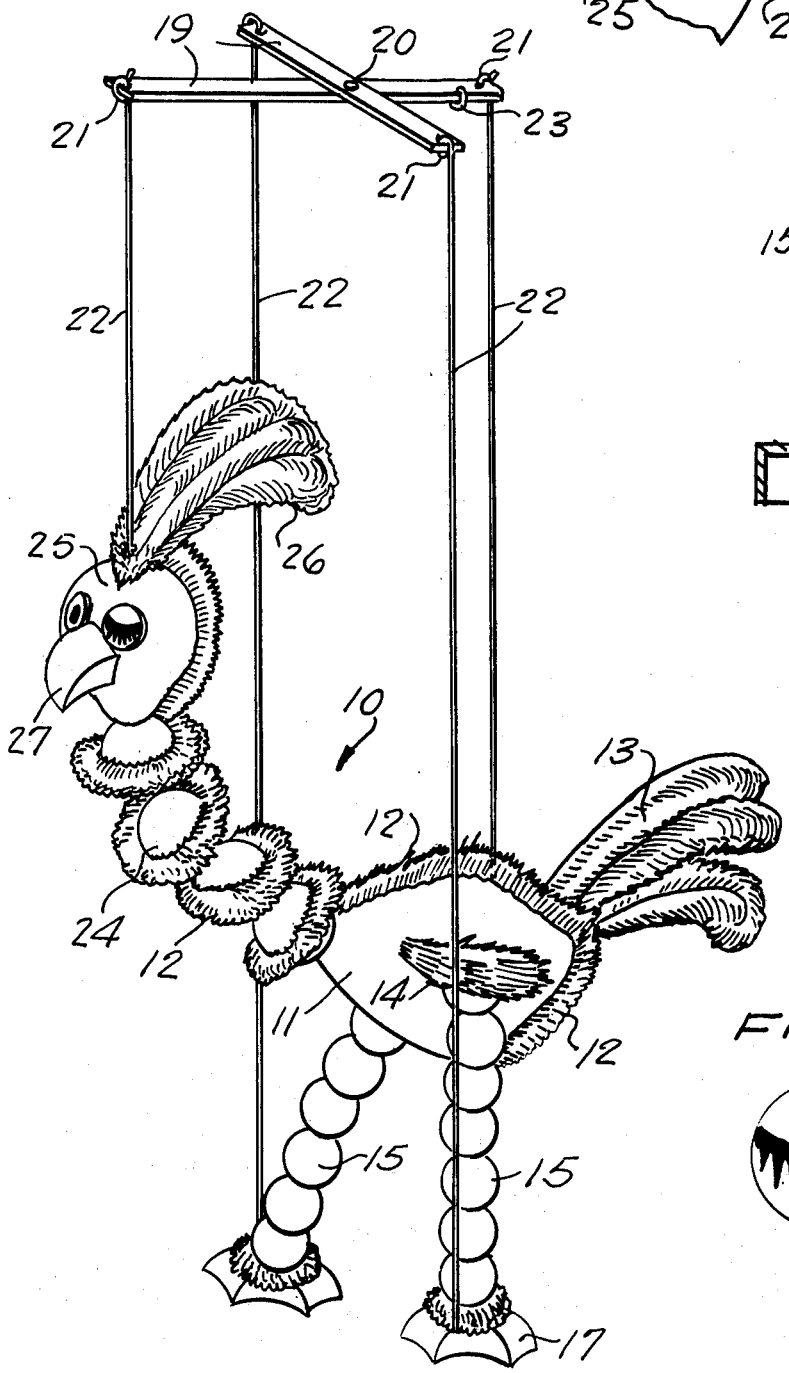
FIG. 4.
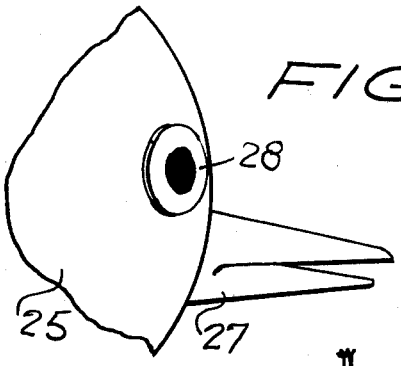
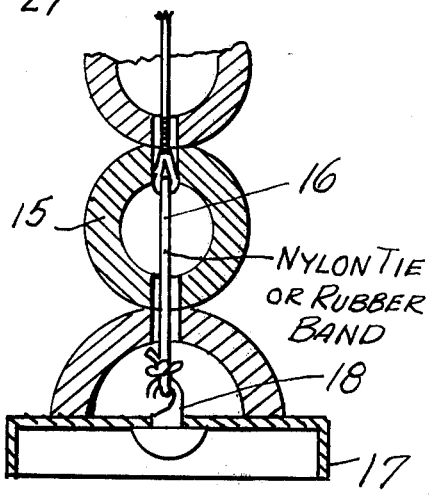
FIG. 5.
FIG. 7. FIG. 8.
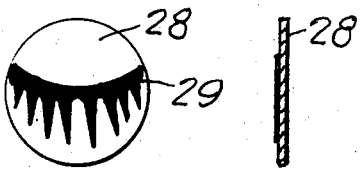

MARIONETTE BIRD

BACKGROUND OF THE INVENTION

FIELD OF THE INVENTION

The present invention relates to hand operated puppets.

SUMMARY OF THE INVENTION

The present invention of a hand operated puppet includes a plurality of styrofoam or urethane balls that are strung together on a nylon cord, or rubber band, with the full body of the bird being operated from a pair of crossed puppet sticks. The body and neck of the figure are made from larger pieces of styrofoam or urethane than the legs and have strips of fake or real fur attached to them, with feathers on top of the head. The two eyes are flat disks, with one showing the eye open and one showing the eye closed, to give the appearance that the bird is blinking. By operating the crossed sticks the bird can be made to walk and perform other motions.

The primary object of the invention is to provide a hand operated puppet having the general appearance of a bird.

Other objects and advantages will become apparent in the following specification with considered in light of the attached drawings.

BRIEF DESCRIPTION OF THE DRAWINGS

FIG. 4 is an enlarged sectional view of the beak of the bird, and its open eye;

FIG. 5 is an enlarged sectional view of one of the birds's feet and the manner in which the nylon cord is attached;

FIG. 6 is a perspective view of the invention showing the appearance of one eye blinking:

FIG. 7 shows a detailed view of the closed eye; and

FIG. 8 shows a side view of the eye disk.

DESCRIPTION OF THE PREFERRED EMBODIMENT

Figure 1:
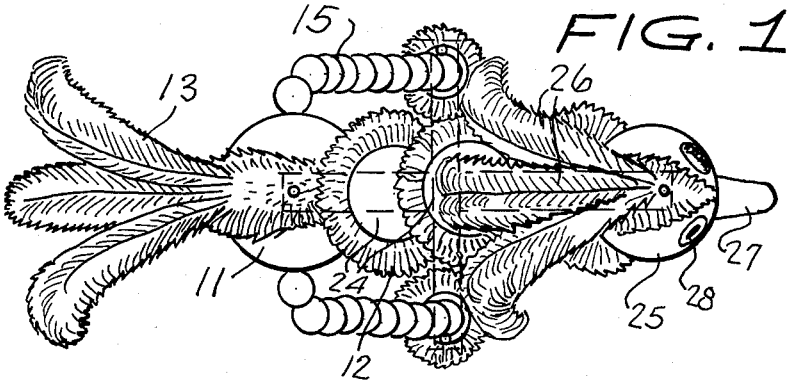
FIG. 1 is a top plan view of the bird.

Referring now to the drawings, wherein like reference characters indicate like parts throughout the several figures, the reference numeral 10 indicates generally a hand operated puppet incorporating the invention.

The puppet 10 takes on the general appearance of a bird which has a relatively large body 11 made from a piece of styrofoam, or any other similar light-weight material. Fastened around the outer periphery of the body 11 there is attached a line of fake fur 12, and a plurality of tail feathers 13, as well as some fur-feathers to form a small wing 14.

Below the body 11 there are attached two strings of styrofoam or fabric balls 15 to form the legs. Balls 15 are smaller in size than the body 11 and have running down through their center a nylon tie string 16 or rubber band. The lowermost part of the leg, or foot area 17 may be constructed from a jar lid, or other stiff material, and has at its center a hook 18 for the bottom attachment of nylon string 16. The top termination of nylon cord 16 is within the side of body 11, and is not shown.

It is obvious that since leg balls 15 have a flexible cord 16 running down loosely through their middle, that they are movable, relative to each other, so that the figure may give the appearance of walking.

Above the puppet figure of bird 10, and in order to give movement to its members, there is a pair of stiff control handles 19, that are pivoted together at point 20. At each end of the control handles 19 there is a hole 21 through which is tied one end of an operating string 22, and also there is provided a stop limit 23 in one of the handles 19 to function as a safety so that the handles cannot open in the wrong direction.

Figure 2:
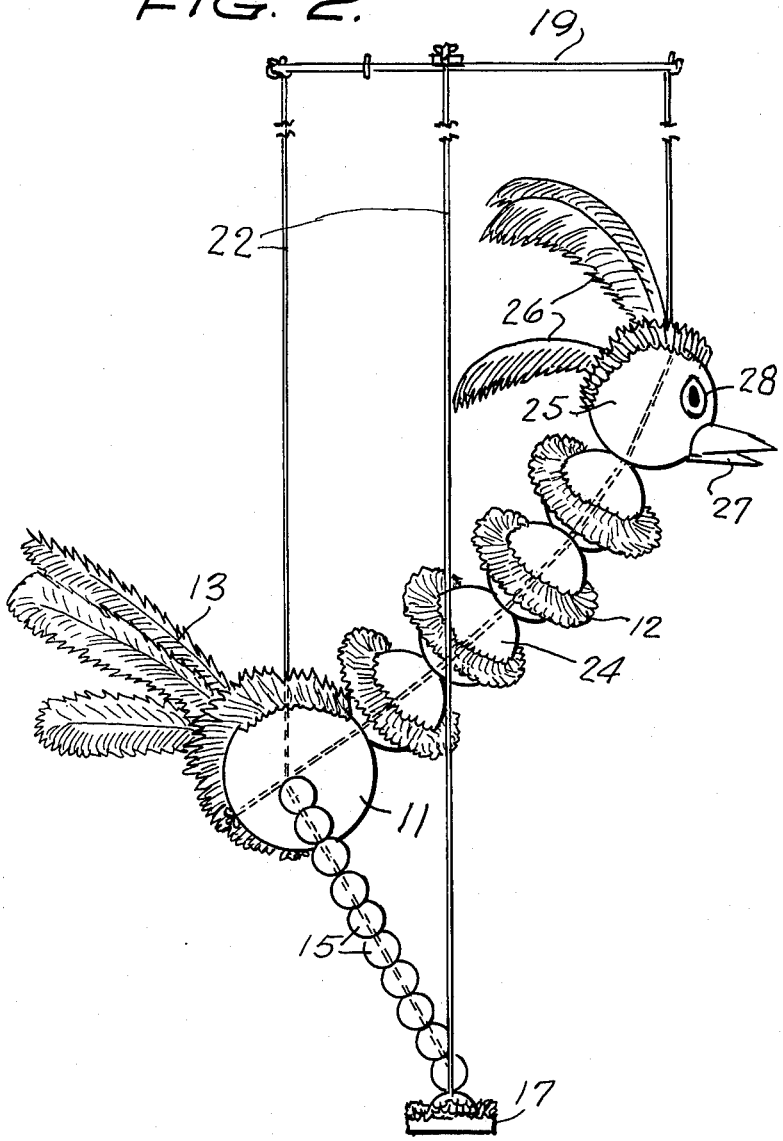
FIG. 2 is a side elevation of the invention showing the styrofoam balls strung together and the operating strings attached.
Figure 3:
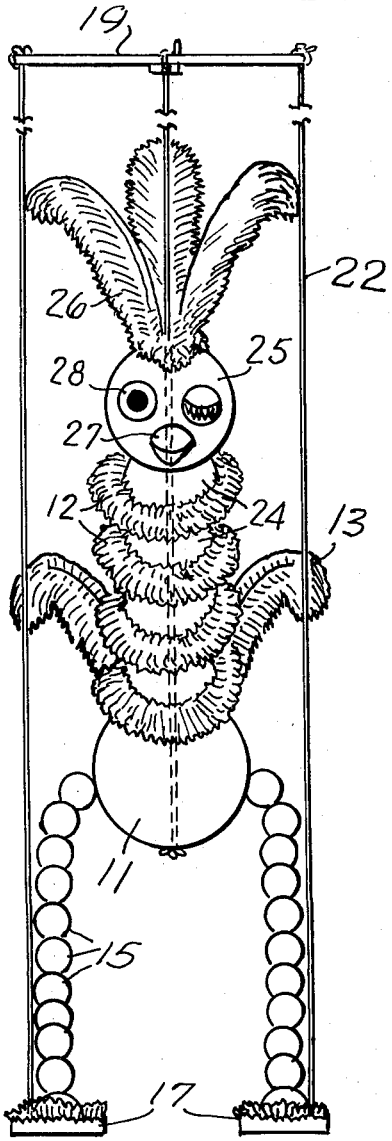
FIG. 3 is a front elevation of the invention.

The four suspension strings 22 are attached to the head, the body, and to each of the feet (FIG. 6). The most important string 22 is probably the one threaded through the head and neck (FIG. 2). There are several round neck balls 24 with a fringe of real or fake fur 12 to give the appearance of a bird. A head-shaped ball 25 is at the top of the string. Several plume features 26 are attached to the head 25, as is a beak 27, the beak being constructed of felt or soft cloth which would not be harmful if the toy is played with by a small child. Observing FIG. 2 it can be seen that suspension string 22 passes through head 25, neck balls 24, and body 11 to terminate in a knot at the lower part of the body.

The two eyes 28, located in the front of head 25, are circular, flat disks or wafers and one portrays an eye that is fully open, while the other has the eye closed by means of lashes 29. Thus, this closed eye gives the appearance that the puppet is winking, or blinking one eye.

In the use and operation of the invention a plurality of fabric, styrofoam or urethane spheres 15 are strung on a nylon cord 16 or even a rubber band, to form two legs 15 that are attached to a body member 11, and thereby construct a portion of a bird simulated puppet. A head 25, with beak 27 and eyes 28 are strung on a string or fish line 22, along with several neck balls 24, to form the other portion of the bird puppet. The overall figure of the bird puppet is supported on four suspension strings 22 that are attached to hand operated control handles 19. Thus, since all of the light-weight individual balls and components are freely strung on string and are not permanently fastened together, by manipulation of handles 19, in characteristic puppet style, the figure of the bird can easily be made to walk, move its head and neck, and follow life-like operation.

It should be readily obvious that since all of the component parts of the bird puppet are either fabric, styrofoam or urethane, with flat resilient eye disks, soft cloth beak, fake fur, and feathers, that the overall structure not only makes up an attractive toys, but one which would not harm even a small child.

Having thus described the preferred embodiment of the invention it should be understood that numerous structural modifications and adaptations may be resorted to without departing from the spirit of the invention.

What is claimed is:

1. A manually operable bird puppet, comprising a generally spheroid body, an elongated flexible neck attached to said body and having a plurality of generally spheroid balls slidably carried on a flexible forwardly extending string, a head having eyes and a beak slidably and rotatably carried on said flexible forwardly extending string with said balls between said body and said head and with said string being longer than the aggregate diameters of said balls and said head, a pair of flexible legs secured at one end to said body and terminating at their distal ends in weighted feet, a cross-shaped control device having a crossbar and a longitudinal bar attached at its forward end to the end of said flexible forwardly extending string remote from said body, a rear string secured to said body and the rear end of said longitudinal bar and shorter than said forwardly extending string, and a pair of side strings secured between the ends of said crossbar and said feet, said side strings having a length sufficient to cause appreciable slack in said flexible legs when said control device is elevated.

2. A manually operable bird puppet as claimed in claim 1 and wherein said body and head and neck balls are formed of lightweight foam material.

3. A manually operable bird puppet as claimed in claim 2 and wherein said foam material is soft polyurethane foam.

4. A manually operable bird puppet as claimed in claim 1 and wherein said flexible legs comprise a plurality of balls smaller than said neck balls carried on flexible cords.

5. A manually operable bird puppet as claimed in claim 1 and wherein said crossbar and said forwardly extending string and said rear string are proportioned so that said weighted feet are positioned forwardly of said body when said control device is elevated.

* * * * *